United States Patent [19]

Riley

[11] Patent Number: 4,545,875

[45] Date of Patent: Oct. 8, 1985

[54] ELECTROLYTIC GRAINING

[75] Inventor: Donald J. Riley, Tenafly, N.J.

[73] Assignee: Polychrome Corporation, Yonkers, N.Y.

[21] Appl. No.: 638,313

[22] Filed: Aug. 6, 1984

[51] Int. Cl.[4] ..... C25F 3/04

[52] U.S. Cl. ..... 204/129.4; 204/129.43; 204/DIG. 9

[58] Field of Search ..... 204/129.4, DIG. 9, 129.43

[56] References Cited

U.S. PATENT DOCUMENTS

| | | | |
|---|---|---|---|
| 4,087,341 | 5/1978 | Takahashi et al. | 204/129.43 |
| 4,294,672 | 10/1981 | Ohba et al. | 204/DIG. 9 X |
| 4,297,184 | 10/1981 | Dyer | 204/DIG. 9 |
| 4,315,806 | 2/1982 | Arora | 204/129.43 X |
| 4,455,200 | 6/1984 | Okamoto | 204/129.4 X |
| 4,468,295 | 8/1984 | Pliefke | 204/129.4 X |

*Primary Examiner*—Donald R. Valentine

[57] ABSTRACT

The invention features an electrolytic process for producing lithographic plates. The plates are immersed in a bath and fed a shaped alternating wave having a multiplicity of zero voltage intermissions. The grain topography of the plate can be varied by changing the frequency and duration of the intermissions in the wave.

5 Claims, 2 Drawing Figures

ELECTROLYTIC GRAINING

FIELD OF THE INVENTION

The invention relates to the electrolytic graining of aluminum plates for lithographic use, and more particularly to a method and apparatus for producing a desirable grain topography in an aluminum plate by means of a shaped alternating current signal.

BACKGROUND OF THE INVENTION

The surface of lithographic aluminum plates are grained to provide proper adhesion to photosensitive layers and wettability to printing inks. In many of the present day graining processes at least one treatment involves the use of an electrolytic acid bath wherein an alternating current is passed between the aluminum plate and a suitable counter-electrode.

Such an electrolytic technique utilizes shaped alternating current wave forms in order to obtain improved graining. One such process is shown in U.S. Pat. No. 4,294,672 to Ohba et al., issued Oct. 13, 1981; the disclosure of which is incorporated herein by reference. This patent discloses a method wherein a zero voltage intermission is shown in the positive or negative phases of the alternating wave form. The quantity of energy is biased to the anodic phase. An aluminum plate so treated will exhibit a roughened surface having a double pit structure wherein pits will develop within pits. Such an irregular surface has been found to provide excellent adhesion to photosensitive coatings.

BRIEF SUMMARY OF THE INVENTION

The present invention features an improved method and apparatus for shaping the alternating current wave form in order to produce an improved grain topography in the aluminum plate. More specifically, the invention provides a process that includes a multiplicity of zero voltage intermissions in both the positive and negative phases of the wave.

The above alternating current is fed to the aluminum plate while the plate is immersed in an acidic bath. Typically, approximately ten intermissions are produced each cycle having a duration of approximately 0.8 m seconds. The resulting plate topography is characterized by a uniform, non-directional distribution of etch pits, without the production of smut, i.e. a dark black surface.

By controlling the frequency and duration of the zero voltage intermissions in the wave, the grain structure of the aluminum plate can be varied to a given or desired condition.

The desired wave form is produced by a transistorized circuit that acts in a switching capacity. A standard alternating current is fed to an input portion of the circuit while a pulse is introduced to the gate portion. Although transistorized switching is well known in the electrical arts, its use in the electrolytic process is novel and leads to improved results.

The term "shaped alternating current signal," as used throughout this specification and in the claims, is intended to encompass modified or chopped alternating current signals.

DETAILED DESCRIPTION OF THE INVENTION

Figure 1:
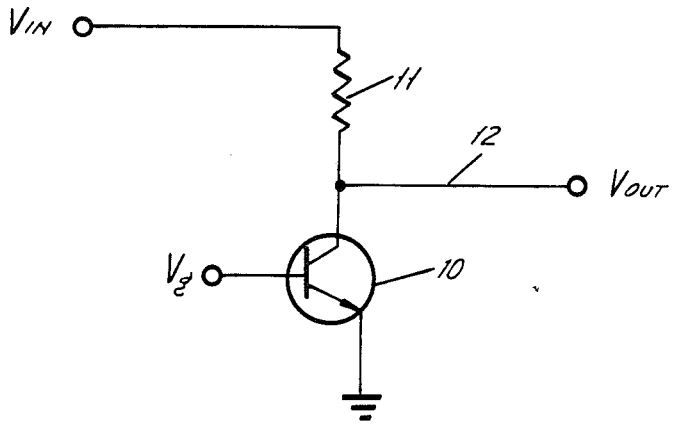
FIG. 1 illustrates an electrical schematic of a typical transistor circuit for use in the described electrolytic process.

Generally speaking, the invention pertains to an improved lithographic plate produced by an improved electrolytic process using a shaped alternating current.

A typical example features a plate of aluminum, such as 1050 aluminum. The aluminum plate is prepared for graining by first etching, using a Ridoline solution manufactured by Amchem for a period of approximately 60 seconds. The etched aluminum is then desmutted using an alkaline wash, such as Hubbard & Hall Deoxidizer No. 4 H&H solution). The resulting plate is then immersed in an electrolytic bath containing a solution of hydrochloric acid of the following aqueous concentration: 10 grams per liter HCl and 1 gram per liter aluminum.

The aluminum plate, acting as an electrode, is subjected to a shaped alternating current of 12.5 $A/dm^2$ having a multiplicity of zero voltage intermission of approximately 0.8 millisecond duration. The frequency of the intermissions is approximately 10 per cycle. The plate is treated in such a manner for approximately sixty seconds. The temperature of the bath is approximately 30° C. The duration of the zero voltage intermission may range from about 0.1 to 2 milliseconds; the frequency of the intermission may vary from about 5 to 20 per cycle, and the temperature of the electrolytic bath may be from 25° to 75° C. with aluminum plate immersions of from 30 to 130 seconds.

The aluminum plate so produced has a desirable uniform, non-directional distribution of etch pits. The resulting pitting gives a lithographic plate surface of superior adhesion and wettability. The plate is now ready for subsequent anodizing, interlayering and coating with a light sensitive layer.

As disclosed in column 2, lines 21 to 55, of U.S. Pat. No. 4,294,672; conventional formulations can be employed as the acidic electrolytic bath solution. The especially preferred aqueous baths contain hydrochloric or nitric acid or mixtures thereof as the electrolyte. The concentration of such electrolytes may vary from about 0.5 to 5% by weight. These and other features of the electrolytic baths discussed in lines 21 to 55 are incorporated herein by reference. This incorporation by reference includes the disclosures in columns 5 and 6 of U.S. Pat. No. 4,294,672 which encompass pretreatment of the aluminum plate before being subjected to the electrochemical graining; treatments intermediate electrochemical graining and coating with a photosensitive material; e.g. anodizing and interlayering with an alkali metal siliciate and/or carboxymethyl cellulose; and the coating treatment with a photosensitive material such as the diazo-containing formulations such as disclosed in U.S. Pat. No. 3,860,426; U.K. published patent application No. 2,030,309A; and the photosensitive materials disclosed in columns 6 and 7 of U.S. Pat. No. 4,294,672.

A typical circuit for producing the above alternating wave form is shown in FIG. 1. A typical N-P-N transistor 10 is used in a switching function. A source ($V_{in}$) of 60 Hz alternating current is fed to the collector of the N-P-N transistor 10 via resistor 11. The emitter of transistor 10 is connected to ground. A pulse signal is applied to the base portion of transistor 10. The shaped alternating wave is obtained on output line 12 ($V_{out}$). The character of the output will depend on the pulse signal ($V_g$) being fed to the base of transistor 10.

Figure 2:
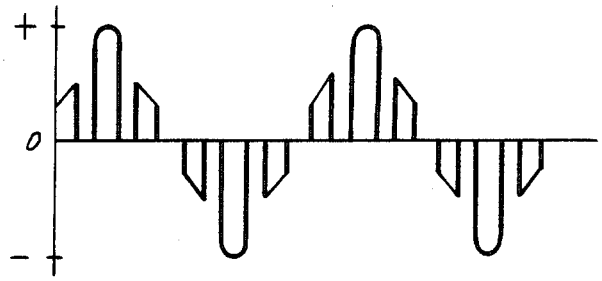
FIG. 2 depicts a typical wave form produced by the circuit of FIG. 1.

A typical output wave form obtained on line 12 is shown in FIG. 2.

The above circuit is powered via a single transformer.

While the above description give a typical example of producing an improved lithographic plate, the present invention is deemed to have broader application. Thus, for example, the duration and frequency of the zero volt intermissions can be changed to provide for a variety of grain topographies, which is considered to be within the scope of this invention. Other modifications and variations within the purview of those skilled in the art are also contemplated with respect to the present invention.

What is claimed is:

1. In the method for preparing a grained aluminum support for lithographic printing plates comprising the treatment of an aluminum plate disposed within an electrolytic bath to a shaped alternating current, the improvement which comprises utilizing a shaped alternating current having a wave form that includes multiple zero voltage intermissions in both cathode and anode phases of said wave form.

2. In the method of claim 1, wherein modification of grain topography occurs by adjusting the frequency of said multiple intermissions.

3. In the method of claim 2 wherein said wave form is applied by introducing said alternating current to said aluminum plate through a transistorized circuit, and wherein said frequency of said intermissions is adjustable by applying a given pulse signal to a gate portion of said transistorized circuit.

4. In the method of claim 1, wherein modification of grain topography occurs by adjusting the duration of said multiple intermissions.

5. In the method of claim 1 wherein said wave form is applied by introducing said alternating current to said aluminum plate through a transistorized circuit.

* * * * *